US007362878B2

(12) United States Patent
Miller et al.

(10) Patent No.: US 7,362,878 B2
(45) Date of Patent: Apr. 22, 2008

(54) MAGNETIC ASSEMBLY FOR A TRANSDUCER

(75) Inventors: Thomas E. Miller, Arlington Height, IL (US); Evan Llamas-Young, Algonquin, IL (US)

(73) Assignee: Knowles Electronics, LLC., Itasca, IL (US)

( * ) Notice: Subject to any disclaimer, the term of this patent is extended or adjusted under 35 U.S.C. 154(b) by 385 days.

(21) Appl. No.: 10/867,340

(22) Filed: Jun. 14, 2004

(65) Prior Publication Data

US 2005/0276433 A1 Dec. 15, 2005

(51) Int. Cl.
*H04R 25/00* (2006.01)

(52) U.S. Cl. ..... 381/418; 381/324

(58) Field of Classification Search ..... 381/312, 381/322, 328, 396, 412, 417, 418, 419, 421, 381/422; 361/752, 753

See application file for complete search history.

(56) References Cited

U.S. PATENT DOCUMENTS

| | | | | |
|---|---|---|---|---|
| 3,935,398 | A | 1/1976 | Carlson et al. | |
| 4,901,293 | A | 2/1990 | Kuhn | |
| 5,193,116 | A | 3/1993 | Mostardo | |
| 5,647,013 | A | 7/1997 | Salvage et al. | |
| 5,960,093 | A | 9/1999 | Miller | |
| 6,041,131 | A | 3/2000 | Kirchhoefer et al. | |
| 6,150,911 | A * | 11/2000 | Katznelson et al. | 335/299 |
| 6,600,400 | B1 | 7/2003 | Andou et al. | |
| 6,909,613 | B2 * | 6/2005 | Augustijn et al. | 381/386 |
| 2002/0136425 | A1 | 9/2002 | Warren | |
| 2003/0190053 | A1 | 10/2003 | van Halteren | |

OTHER PUBLICATIONS

"Carpenter High Permeability "49" Alloy", CARPENTER Specialty Alloys, 7 pages, 1992.
"Standard Specifications for Permanent Magnet Materials"; MMPA Standard No. 100-00, Magnetic Materials Producers Association, 28 pages, 1964.
"Rare-Earth Permanent Magnets, Vacodym • Vacomax," Internet Article, XP-002317685, www.vacuumschmelze.de, 2003, 48 pages.
"Soft Magnetic Cobalt-Iron-Alloys, Vacoflux 48 • Vacoflux 50 • Vacodur 50 • Vacoflux 17," Internet Article, XP-002317686, www.vacuumschmelze.de, 2001, 7 pages.
International Search Report for Application No. PCT/US04/018570 dated Mar. 11, 2005.

* cited by examiner

*Primary Examiner*—Brian Ensey
(74) *Attorney, Agent, or Firm*—Marshall, Gerstein & Borun LLP

(57) ABSTRACT

A transducer suitable for use as a microphone or receiver in a hearing aid has a housing and a diaphragm disposed within the housing. A motor assembly is also disposed within the housing and operatively coupled to the diaphragm. The motor assembly includes a magnet assembly having a magnetic yoke forming a channel and a drive magnet disposed within the channel.

13 Claims, 2 Drawing Sheets

MAGNETIC ASSEMBLY FOR A TRANSDUCER

TECHNICAL FIELD

This patent generally relates to transducers useful in listening devices, such as hearing aids or the like, and more particularly, to a magnetic assembly for use in a transducer.

BACKGROUND

Hearing aid technology has progressed rapidly in recent years. Technological advancements in this field continue to improve the miniaturization, reception, wearing-comfort, life-span, and power efficiency of hearing aids. With these continual advances in the performance of ear-worn acoustic devices, ever-increasing demands are placed upon improving the inherent performance of the miniature acoustic transducers that are utilized. There are several different hearing aid styles known in hearing aid industry: Behind-The-Ear (BTE), In-The-Ear or All-In-The-Ear (ITE), In-The-Canal (ITC), and Completely-In-The-Canal (CTC).

Generally, a listening device, such as a hearing aid or the like, includes a microphone assembly, an amplifier and a receiver (speaker) assembly. The microphone assembly receives acoustic sound waves, and generates an electronic signal representative of these sound waves. The amplifier accepts the electronic signal, modifies the electronic signal, and communicates the modified electronic signal (e.g. processed signal) to the receiver assembly. The receiver assembly, in turn, converts the increased electronic signal into acoustic energy for transmission to a user.

A known receiver assembly comprises a housing, an armature, a drive rod, a pair of drive magnets, a diaphragm, a drive coil, a yoke, a sound outlet port, and an electrical terminal. The diaphragm is disposed within the housing, defining an output chamber and a motor chamber. The armature is disposed within the motor chamber and has an operative element comprising a fixed end and a movable end. The armature is coupled by the drive rod to drive the diaphragm. The drive magnet structure having a central passage surrounds the movable end of the armature and provides a permanent magnetic field within the passage. The drive coil is disposed about the armature and is located proximate to the permanent magnet structure.

To provide a magnetic flux, the drive magnet may be disposed within the magnetic yoke. The drive magnet may be made of a hard magnetic material, such as, for example, Ferrite, Alnico. The magnetic yoke may be made of Nickel-Iron. This arrangement of the magnet assembly (drive magnet-magnetic yoke structure) has several disadvantages. The hard magnetic material used in the drive magnet often has a relatively low energy content and further it requires a certain thickness to provide sufficient flux density. Moreover, the overall size of the magnetic yoke must be made large enough to avoid magnetic saturation. Also, the physical volume of the material places limits on the size of the receiver assembly making size reductions difficult.

Accordingly, there is a need for a transducer, for example a microphone or receiver that is inexpensive, simple to manufacture and scalable to relatively small sizes.

BRIEF DESCRIPTION OF THE DRAWINGS

For a more complete understanding of the disclosure, reference should be made to the following detailed description and accompanying drawings wherein.

DETAILED DESCRIPTION

Figure 1:
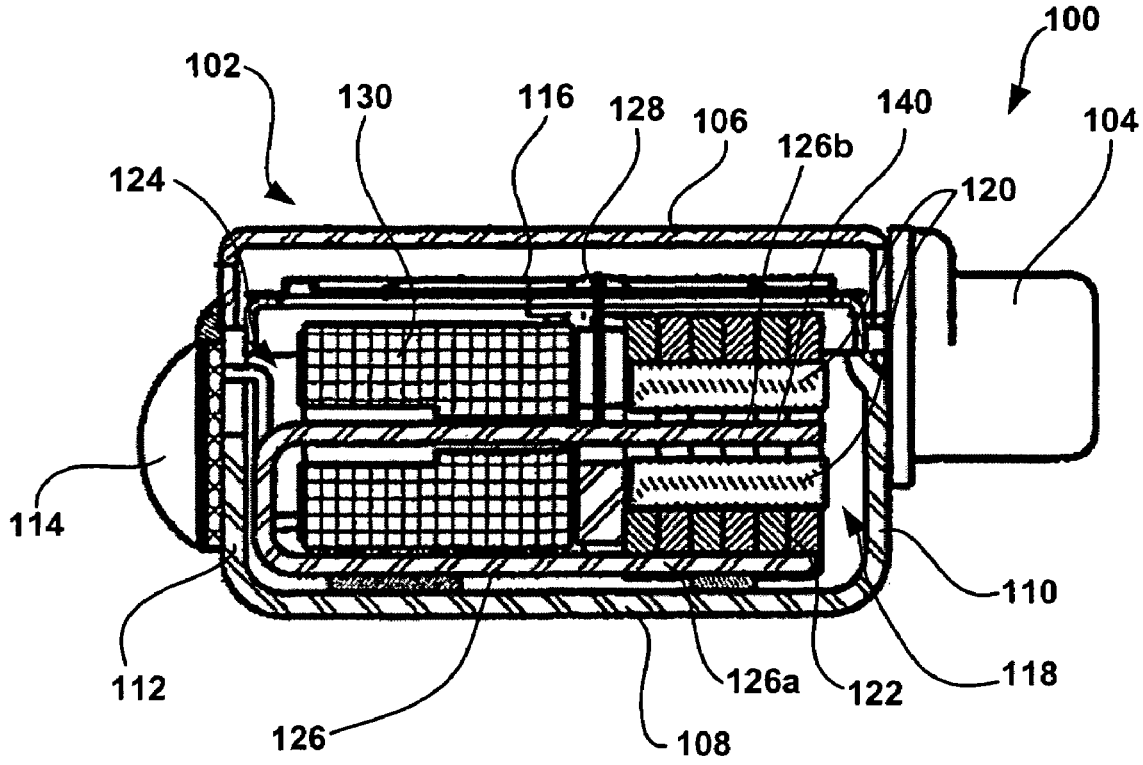
FIG. 1 is a cross-sectional view of a transducer according to a described embodiment of the invention.

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

Figure 2:
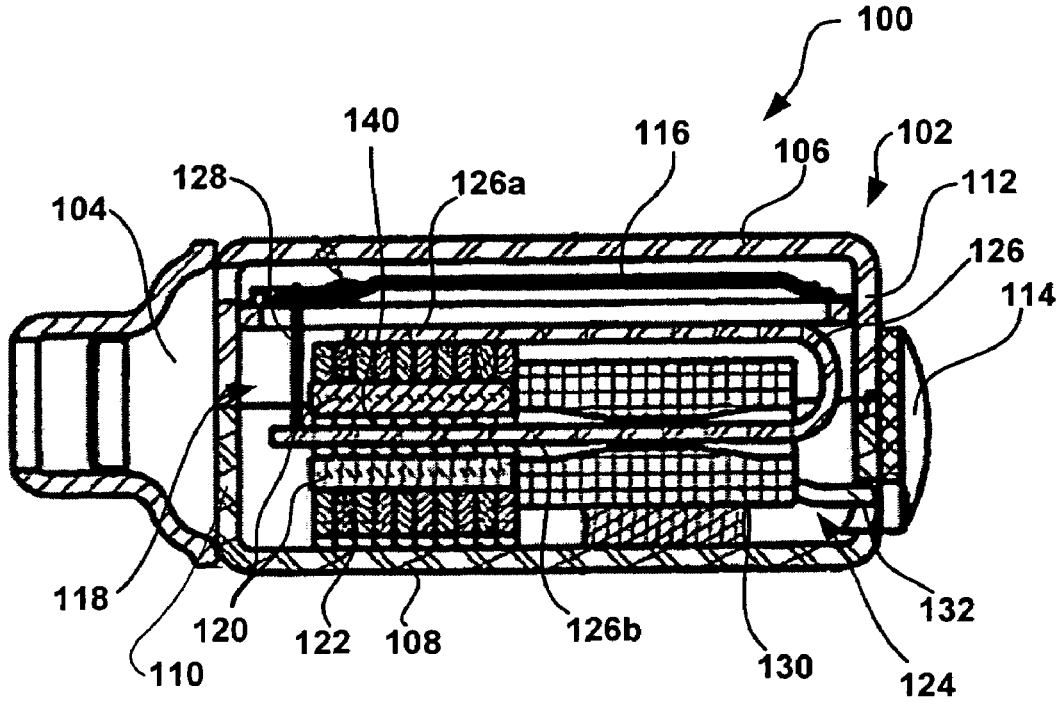
FIG. 2 is a cross-sectional view of a transducer according to a described embodiment of the invention.

FIGS. 1-2 illustrate a cross-sectional view of a transducer 100. The transducer 100 may be adapted as either a microphone, receiver or other such device, and may be useful in such devices as hearing aids, in-ear monitors, headphones, electronic hearing protection devices, and very small scale acoustic speakers. The transducer 100 includes a housing 102 having at least one sound outlet port 104. The housing 102 may be rectangular in cross-section, with a planar top 106, a bottom 108, and side walls 110, 112. In alternate embodiments, the housing 102 can be manufactured in a variety of configurations, such as, a cylindrical shape, a D-shape, a trapezoid shape, a roughly square shape, or any other desired geometry. In addition, the scale and size of the housing 102 may vary based on the intended application, operating conditions, required components, etc. An optional electrical terminal 114 may be affixed to the side wall 112 of the housing 102 by bonding or any other suitable method of attachment. The transducer 100 may further include operatively coupled a diaphragm 116, a magnet assembly 118, and a motor assembly 124.

The magnet assembly 118 includes a pair of drive magnets 120 to provide sufficient electromagnetic flux density fixedly attached to a magnetic yoke 122. The magnet assembly 118 may generally be shaped to correspond to the shape and configuration of the housing 102 but may be formed to compliment the various shape and sizes of the different embodiments. The magnetic yoke 122 forms a rectangular frame having a central tunnel or channel defining an enclosure into which the drive magnets 120 mount and form an air gap 140 to carry the electromagnetic flux of the drive magnets 120 and the drive coil 130.

The motor assembly 124 includes an armature 126, a link or drive rod 128, a drive coil 130, and a lead 132. The drive coil 130 and the electrical terminal 114 are both operably attached to the lead 132. In other embodiments, the link or drive rod 128 may be a linkage assembly or a plurality of linkage assemblies. One of skill in the art will appreciate the principles and advantages of the embodiments described herein may be useful with all types of receivers, such as those with U-shaped or E-shaped armatures.

The diaphragm 116 and the armature 126 are both operably attached to the drive rod 128. In alternate embodiments, the armature 126 may be affixed to the diaphragm 116 by any other suitable method of attachment without utilizing the drive rod 128. In other embodiments, more than one diaphragm may be used to increase the radiating area and increase the output of or sensitivity to acoustical signals of the transducer 100. The diaphragm 116 is shown to have at least one layer. However, the diaphragm 116 may utilize multiple layers. The armature 126 includes a fixed end 126*a* and a movable end 126*b*. The movable end 126*b* of the armature 126 extends along the drive coil 130 and the magnet assembly 118, which in turn connects to the diaphragm 116 with the drive rod 128. The fixed end 126*a* of the armature 126 extends on the outer side along the drive coil 130 and within the housing 102. As shown in FIG. 1, the fixed end 126*a* of the armature 126 is affixed to the housing by bonding or any other suitable method of attachment. In other embodiments, the fixed end 126*a* of the armature 126 may be affixed to the outer side of the magnetic yoke 122 near to the diaphragm 116 (as shown in FIG. 2) to reduce the overall size of the transducer 100.

Figure 3:
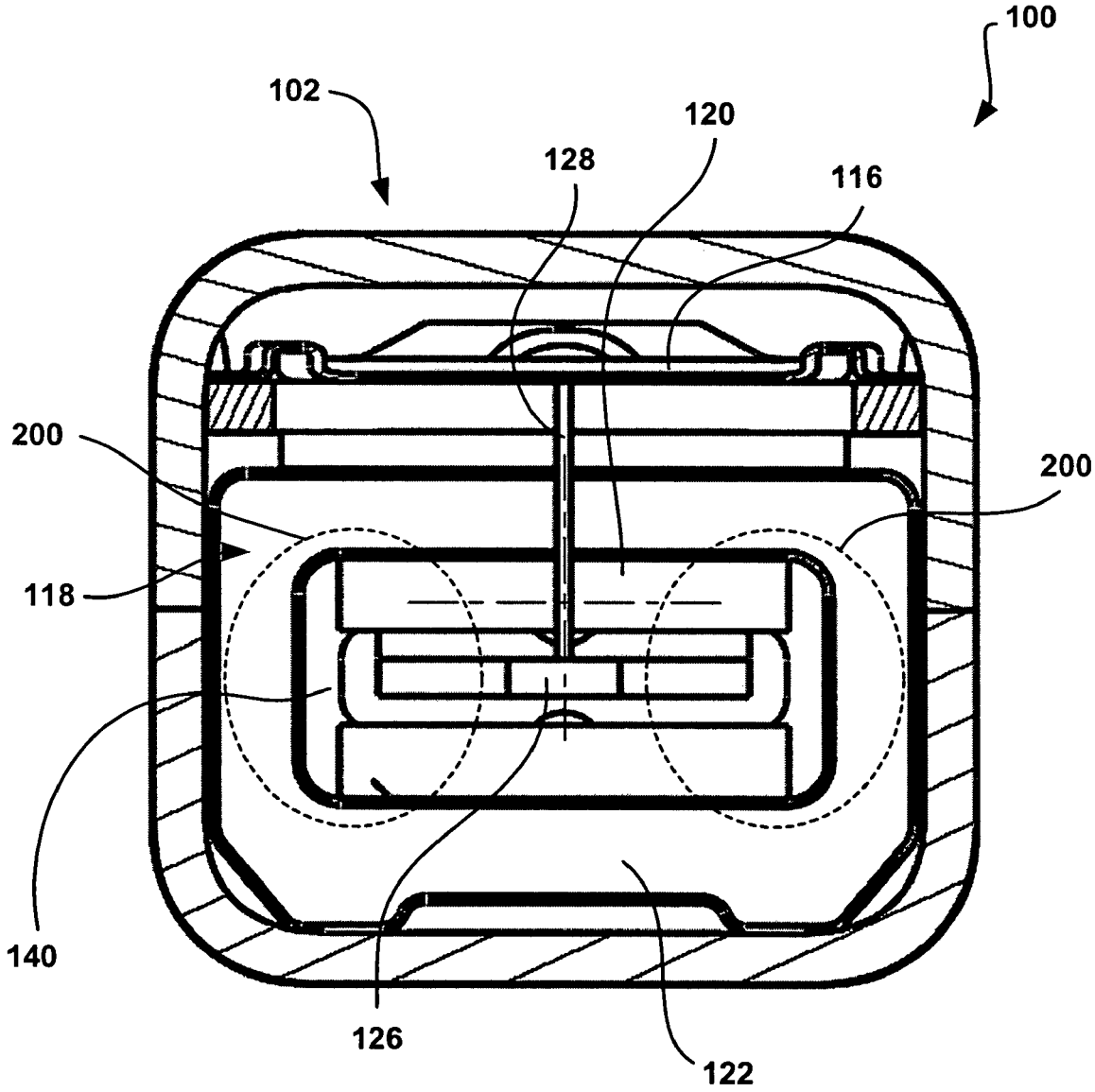
FIG. 3 is a cross-sectional view of a transducer according to a described embodiment of the invention.

FIG. 3 further illustrates the magnet assembly 118 and the construction of the transducer 100. The magnet assembly 118 includes a pair of drive magnets 120 fixedly attached to a magnetic yoke 122. The magnet assembly 118 exhibits high magnetic flux density in a small size owing to the high saturation inductance, high permeability and low coercivity material for the magnetic yoke 122 and a high energy product and high coercivity material for the drive magnets 120.

The magnetic yoke 122 may be made of soft magnetic material having a high permeability and a high saturation inductance. For example, the magnetic yoke 122 may be an Iron-Cobalt Vanadium (FeCoV) alloy, commonly available under the trade designation Permendur Hiperco 50A from Carpenter Technology Corporation, or of any similar materials. Generally, the material forming the magnetic yoke 122 should have a saturation inductance tesla (T) greater than 1.5 and preferably at least 2.0; a maximum permeability greater than about 10,000 and preferably greater than about 75,000; and a coercivity ampere per meter (A/m) less than 140.

The drive magnets 120 may be made of a rare earth magnetic material having improved magnetic properties, improved intrinsic coercive forces, and improved maximum energy products. For example, the drive magnets 120 may be a Samarium-Cobalt ($SmCo_5$, $Sm_2Co_{17}$) alloy, a Neodymium-Iron-Boron (NdFeB) alloy, or of any similar materials. In an embodiment using Samarium-Cobalt alloy, the drive magnets have a high magnetic flux density which thereby allows a reduction in the overall thickness of the transducer 100. Generally, the material forming the drive magnets 120 should have an energy product kilo-joules per cubic meter ($kJ/m^3$) greater than about 72, and preferably about 191 to about 422; saturation inductance telsa (T) greater than 1 and preferably about 1-1.5 and a coercivity ($h_{cB}$, kA/m) greater than 140 and preferably about 690 to about 1040.

When the transducer 100 is used as a receiver, a current representing an input audio signal from the electrical terminal 114 is applied to the drive coil 130, a corresponding alternating current. (a.c.) magnetic flux (not depicted) is produced from the drive coil 130 through the armature 126, drive magnets 120, and the magnetic yoke 122. Further, a corresponding direct current (d.c.) magnetic flux path 200 is produced from a first side of the magnet assembly 118, e.g., an upper member of the drive magnet 120 to the upper member of magnetic yoke 122 as shown in FIG. 3, to a second side of the magnet assembly 118, e.g., a lower member of magnetic yoke 122 to a lower member of the drive magnet 120 and across the air gap 140 as shown in FIG. 3. The movable end 126*b* of the armature 126 vibrates in response to the electromagnetic forces generated by the magnetic flux 200 produced by the magnet assembly 118 and the drive coil 130, which in turn, leads to the movement of the drive rod 128. The diaphragm assembly 116 moves in response to the vertical motion of the armature movable end 126*b* driven by the drive coil 130. The transducer 100 utilizes the corresponding motion of the armature movable end 126*b* and the diaphragm assembly 116 to generate output acoustical signal towards the user's eardrum. Doing so provides the advantages of reduced overall size of the receiver assembly while maintaining high efficiency.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A transducer comprising:

a housing for the transducer;

a diaphragm moveably disposed within the housing;

a motor assembly disposed within the housing, the motor assembly including operatively coupled: a fixed coil, an armature coupled to the diaphragm, and a magnet assembly located under the diaphragm, wherein the magnet assembly has a magnetic yoke formed to include a channel and having a saturation inductance greater than about 1.5 T and a high performance drive magnet has a reduced thickness disposed within the channel, the drive magnet having at least one of an energy product greater than about 72 kJ/m3 and a coercivity greater than about 140 kA/m.

2. The transducer of claim 1, wherein the armature and the diaphragm are coupled to a drive linkage.

3. The transducer of claim 1, wherein the magnetic yoke has a saturation inductance of about 2.0 T.

4. The transducer of claim 1, wherein the magnetic yoke comprises an iron-cobalt (FeCo) alloy.

5. The transducer of claim 1, wherein the magnetic yoke comprises an iron-cobalt-vanadium (FeCoV) alloy.

6. The transducer of claim 1, wherein the drive magnet comprises a first drive magnet and a second drive magnet disposed within the channel.

7. The transducer of claim 1, the drive magnet having an energy product greater than about 72 kJ/m3 saturation inductance greater than about 1 T, and a coercivity greater than about 140 kA/m.

8. The transducer of claim 1 the drive magnet having an energy product of about 191 to about 42 kJ/m3.

9. The transducer of claim 1, the drive magnet having a coercivity of about 690 to about 1040 kA/m.

10. The transducer of claim 1, wherein the drive magnet comprises an alloy selected from the group of alloys consisting of Samarium-Cobalt (SmCo) alloy and Neodymium-Iron-Boron (NdFeB).

11. The transducer of claim 1, the drive magnet comprising a first drive magnet disposed on a first side of the channel and a second drive magnet disposed on a second side of the channel, and the armature being disposed within the channel between the first drive magnet and the second drive magnet.

12. The transducer of claim 1, wherein the transducer is one of a microphone and a receiver.

13. The transducer of claim 1, the transducer being adapted for use in at least one of a hearing aid; an in-ear monitor; a headphone; an electronic hearing protection device and a speaker.

* * * * *

UNITED STATES PATENT AND TRADEMARK OFFICE

CERTIFICATE OF CORRECTION

PATENT NO. : 7,362,878 B2
APPLICATION NO. : 10/867340
DATED : April 22, 2008
INVENTOR(S) : Thomas E. Miller et al.

It is certified that error appears in the above-identified patent and that said Letters Patent is hereby corrected as shown below:

On the Title Page:

At field (75), first named Inventor, "Arlington Height" should be -- Arlington Heights --.

At field (73), "LLC." should be -- LLC --.

In the Claims:

At Column 5, line 18, "claim 1" should be -- claim 1, --.

At Column 5, line 19, "42" should be -- 422 --.

Signed and Sealed this

Nineteenth Day of August, 2008

JON W. DUDAS
*Director of the United States Patent and Trademark Office*